United States Patent [19]

Petroons

[11] 4,394,637

[45] Jul. 19, 1983

[54] WOUND BOBBIN COIL APPARATUS

[75] Inventor: Jose O. G. Petroons, Beersel, Belgium

[73] Assignee: U.S. Philips Corporation, New York, N.Y.

[21] Appl. No.: 282,194

[22] Filed: Jul. 10, 1981

[51] Int. Cl.[3] ..... H01F 15/10

[52] U.S. Cl. ..... 336/192

[58] Field of Search ..... 174/138 F; 310/71, 194; 336/192, 208, 198

[56] References Cited

U.S. PATENT DOCUMENTS 3,453,575 7/1969 Davis ..... 336/192

3,739,312 6/1973 Knebel ..... 336/192

*Primary Examiner*—Thomas J. Kozma

*Attorney, Agent, or Firm*—Robert S. Smith

[57] ABSTRACT

A wound bobbin coil apparatus includes a coil form having a generally cylindrical surface having disposed at axial extremeties thereof generally circular side flanges. The coil form includes generally L-shaped cooperating locking member extending respectively from the generally circular side flanges, said locking members include means for locking engagement therebetween and include means for engaging a plurality of associated wires. The L-shaped locking members have at least one face thereof having a plurality of upstanding bosses disposed thereon in spaced relationship to allow entrance of termination wires therebetween.

5 Claims, 6 Drawing Figures

WOUND BOBBIN COIL APPARATUS

BACKGROUND OF THE INVENTION

The invention relates to coils and has particular application to wound bobbin coil apparatus typically used in small electric motors.

Wound bobbins are widely used in the fabrication of small electric motors. The bobbins are typically automatically wound, by various types of machinery, with relatively small copper wire. Such copper wire typically is provided with only a varnish type insulation. The wires are provided with extensions or "terminations" which are typically multistrand wires having a substantially greater outside diameter and having conventional insulation disposed over most of the axial extent thereof. Such terminations are necessary to provide durability which would not be possible with the relatively fragile wire which is used for the windings of the coil itself.

The prior art techniques for providing such terminations commonly include the utilization of a so-called "saddle" which holds the terminations (typically two in number) while the various connections are made. While the prior art method has been widely used it does not appear to offer the maximum efficiency.

It is an object of the invention to provide a coil construction which will be extremely durable and which more specifically, will provide substantial strain relief for the terminations.

It is another object of the invention to provide a construction which will require substantially less labor than is necessary to assemble apparatus of a more conventional design.

Yet another object of the invention is to provide apparatus which can be manufactured at a relatively low cost both for labor and material.

SUMMARY OF THE INVENTION

It has now been found that these and other objects of the invention may be attained in a coil construction in which:

a wound bobbin coil apparatus includes a coil form having a generally cylindrical surface having disposed at respective axial extremeties thereof first and second generally circular side flanges. The coil form includes first and second generally L-shaped cooperating locking member extending respectively from the first and second generally circular side flanges. The locking members include means for locking engagement therebetween and include means for engaging a plurality of associated wires. The L-shaped locking members have at least one face thereof having a plurality of upstanding bosses disposed thereon in spaced relationship to allow entrance of termination wires therebetween.

The coil form may be manufactured by a synthetic plastic material. The coil form and the locking members may allow bending movement therebetween along a line which is generally tangential to the circumferential extent of the generally circular side flanges.

The first locking member may include a plurality of wedge-shaped members and said second locking member may include a generally wedge-shaped surface thereon for cooperation with at least some of said wedge-shaped members on said first locking member.

At least one of said locking members may include a plurality of wedge-shaped surfaces disposed in a matrix.

BRIEF DESCRIPTION OF THE DRAWING

The invention will be better understood by reference to the accompanying drawing in which.

DESCRIPTION OF PREFERRED EMBODIMENT

Figure 1:
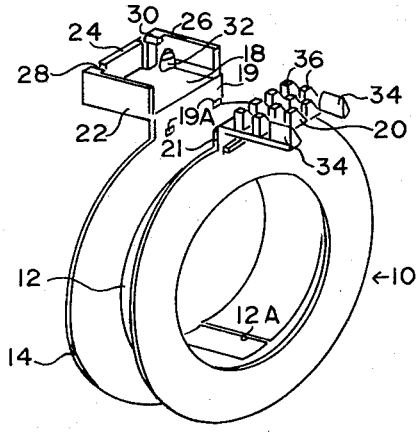
FIG. 1 is a perspective view of the coil form in accordance with the invention.

Referring now to FIGS. 1–6, there is shown a coil form 10 in accordance with one form of the invention. The coil form 10 includes a generally cylindrical 12 having axially spaced circular side member or flanges 14, 16. A reference surface 12A is provided to cooperate with coil winding machinery and insure that the coil form 10 is positioned properly during winding. Carried along the circular side flanges 14, 16 are respectively rectangular plate shape members 18, 20. The members 18, 20 are disposed in generally aligned relationship and is best seen in FIG. 1.

Ordinarily the coil form 10 will be manufactured of a synthetic material such as nylon. The material used may in some forms of the invention be a glass filled nylon material which is particularly suitable for high temperature applications. The plate shaped members 18, 20 ordinarily will be molded in a manner which need not have the elasticity inherent in known plastic hinges. The molding process ordinarily will not require any special treatment to improve the hinge characteristics of the material and the coil form 10 ordinarily will be merely injection molded. Instead, it is sufficient to have merely enough elasticity to enable folding of the plate shaped members 18, 20 to the engaged position shown in FIG. 6. Once folded to this position no further bending is required.

The plate shaped member 18 includes upstanding side flanges 22, 24, and 26. A gap 18 is disposed intermediate the flange 22 and the flange 24. Similarly, a gap 30 is disposed intermediate the flange 26 and the flange 24. A reinforcing rib 32 is disposed on the inner face of the upstanding flange 26 as seen in FIG. 1. Although not visible in FIG. 1, a reinforcing rib is similarly positioned on the interface of the upstanding flange 22.

The plate shaped member 20 includes locking members 34, 34 which have a generally wedge shaped cross section and which engage the slots 28 and 30. Ordinarily the slots 28, 30 will have steps disposed adjacent to the open end thereof and the wedge shaped members 34 will also have steps as shown in FIG. 1. The cooperating steps are dimensioned and configured for locking engagement when the two plate shaped members 18, 20 are moved to the positioned illustrated in FIG. 6. The shape of the steps in the slots 28, 30 is visible in FIG. 6. The ribs 32 further insure locking cooperation of the slots 28, 30 with the wedge shaped members 34 by insuring that little twisting occurs which might inadvertently disengage the cooperating surfaces.

Also disposed on the plate shaped member 20 are a plurality of generally wedge shaped bosses 36 which are disposed in a matrix of rows and columns. Ordinarily the bosses 36 will be oriented so that the wedge shaped cross section has the elongated "peak" thereof disposed in generally aligned relationship with the axis of the cylindrical member 12 as well as with the elongated "peak" of the wedge shaped member 34.

The plate shaped members 18, 20 will be respectively joined to the generally circular members 14, 16 by tabs 19, 21. These tabs 19, 20 are intended to bend at the generally tangential intersection with the generally circular members 14, 16. Holes 19A are proved to insure that the generally L-shaped assemblies of the plate 19 and the tab 19A bend also at the generally tangential intersection with the generally circular member 14. In a similar manner the tab 21A is also provided with similar holes to insure that the generally L-shaped sub-assembly of the plate member 20 and table 21 will bend along the line of intersection with the generally circular plate or end member 16.

Figure 2:
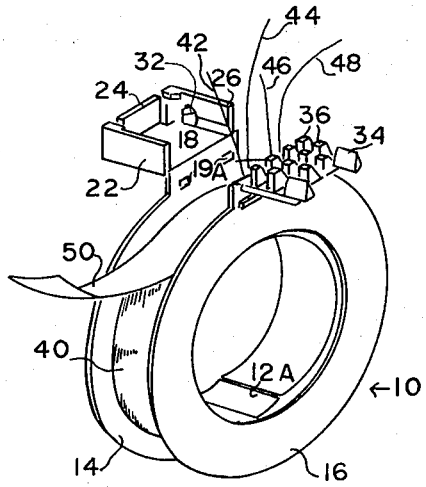
FIG. 2 is a perspective view showing the coil form after installation of a copper wire thereon.

As shown in FIG. 2 automatic coil winding machinery is ordinarily used to position a bifilar coil of copper wire 40 intermediate the circular flanges 14, 16. The axial extremities of the copper windings are indentified by the numerals 42, 44, 46, and 48. Ordinarily a portion of the coil is covered with tape 15 as shown in FIG. 2.

Figure 3:
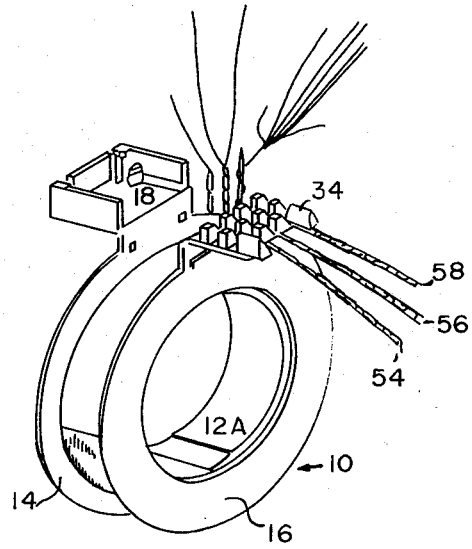
FIG. 3 is another perspective view showing the manner of connecting terminations and the positioning of these terminations with respect to the coil form.
Figure 4:
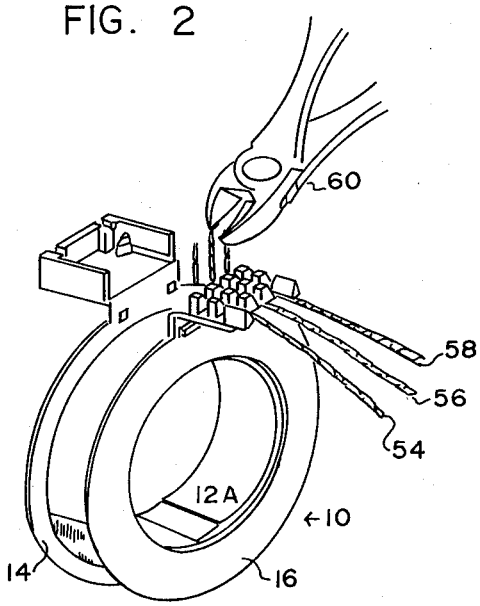
FIG. 4 is a perspective view further illustrating the method of connecting the terminations.

Ordinarily the upstanding bosses 36 will be disposed in four discrete area rows extending in a direction generally aligned with the axis of the cylindrical member 12. The space is intermediate these rows are occupied by 3 terminations 54, 56 and 58 as best shown in FIG. 3. It will be understood that it is normal practice to provide only three terminations 54, 56 and 58 even though there are four axial extremities 42, 44, 46 and 48 of the windings 40. This is possible, of course, since two of the axial extremities are connected to a single termination. As also seen in FIG. 3 the axial extremity 42–48 are connected to the terminations 54–58 by twisting. Thereafter, as shown in FIG. 4, diagonal cutters 60 are utilized to cut the upstanding axial extremities 42–48 in the stripped ends of the terminations 54–58 to a suitable length.

The utilization of discrete wedge shaped bosses 36 is ordinarily preferable to a single continuous channel for each termination wire 54, 56, and 58 because the discrete bosses 26 insure better gripping of the terminations 54, 56, and 58 and also make insertion of the terminations 54, 56, and 58 into the spaces intermediate the bosses 36 easier.

Figure 5:
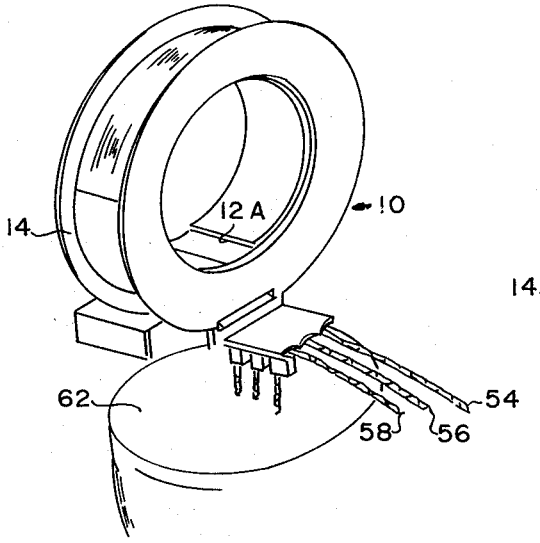
FIG. 5 is a perspective view illustrating the manner of soldering the terminations.
Figure 6:
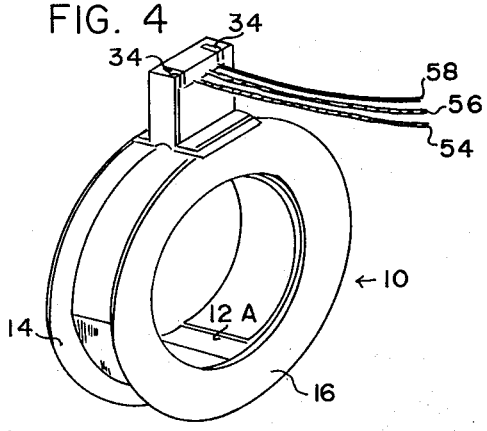
FIG. 6 is a perspective view of the complete coil assembly in accordance with one form of the invention.

Thereafter as shown in FIG. 5, the axial extremities 42–48 and the terminations and stripped ends of the terminations 54–58 are dipped into a reservoir 62 of molten solder. After this has been accomplished the generally plate shaped members are closed together in locking engagement as shown in FIG. 6. When so positioned the terminations 54–58 extend intermediate the free end of the plate shaped member 20 and the flange 24 of the member 18. We see that the locking engagement of the wedge shaped members 34, 34 with the spaces 28, 30 insures a positive and permanent relationship between the plate shaped members 18, 20.

It will be further seen that the apparatus in accordance with the invention results in a positive locking arrangement which has a pleasing appearance but which is highly durable, in addition the recited steps can be performed very rapidly with a minimum of material and labor costs.

What is claimed is:

1. A wound bobbin coil apparatus which comprises:

a coil form having a generally cylindrical surface having disposed at respective axial extremeties thereof first and second generally circular side flanges;

said coil form including first and second generally L-shaped cooperating locking members extending respectively from said first and second generally circular side flanges, said locking members including means for locking engagement therebetween and including means for engaging a plurality of associated wires, said L-shaped locking members having at least one face thereof having a plurality of upstanding bosses disposed thereon in spaced relationship to allow entrance of termination wires therebetween.

2. The apparatus as described in claim 1, wherein:

said coil form is manufactured of a synthetic plastic material.

3. The apparatus as described in claim 2, wherein:

said coil form and said locking members allow bending movement therebetween along a line which is generally tangential to the circumferential extent of said generally circular side flanges.

4. The apparatus as described in claim 3, wherein:

said locking means including a plurality of wedge-shaped members on said first locking member and generally wedge-shape surfaces on said second locking member for cooperation with at least some of said wedge-shaped members on said first locking member.

5. The apparatus as described in claim 4, wherein:

said bosses being disposed in a matrix and having wedge-shaped surfaces.

* * * * *